United States Patent [19]

Leonhardt

[11] 4,051,698

[45] Oct. 4, 1977

[54] GUIDE BAR ASSEMBLY FOR A WARP KNITTING MACHINE

[76] Inventor: Herbert Leonhardt, Carboonstraat 15, Kerkrade-West, Netherlands

[21] Appl. No.: 739,191

[22] Filed: Nov. 5, 1976

[30] Foreign Application Priority Data

Nov. 13, 1975 Germany ..... 2550921
Nov. 13, 1975 Germany ..... 7536036

[51] Int. Cl.[2] ..... D04B 23/00; D04B 27/00
[52] U.S. Cl. ..... 66/205; 66/214
[58] Field of Search ..... 66/203, 204, 205, 214, 66/207

[56] References Cited

U.S. PATENT DOCUMENTS 3,303,670 2/1967 Bassist ..... 66/207

FOREIGN PATENT DOCUMENTS 661,298 4/1963 Canada ..... 66/214

*Primary Examiner*—Ronald Feldbaum
*Attorney, Agent, or Firm*—Cushman, Darby & Cushman

[57] ABSTRACT

A guide bar assembly for use in a warp knitting machine in which a plurality of ferromagnetic, tubular yarn carrier elements are disposed between two bar rails forming a guide bar and can be shifted longitudinally independently from each other. The elements are magnetically held in apertures between the bar rails which can be longitudinally shifted in opposite directions to shift the elements.

4 Claims, 7 Drawing Figures

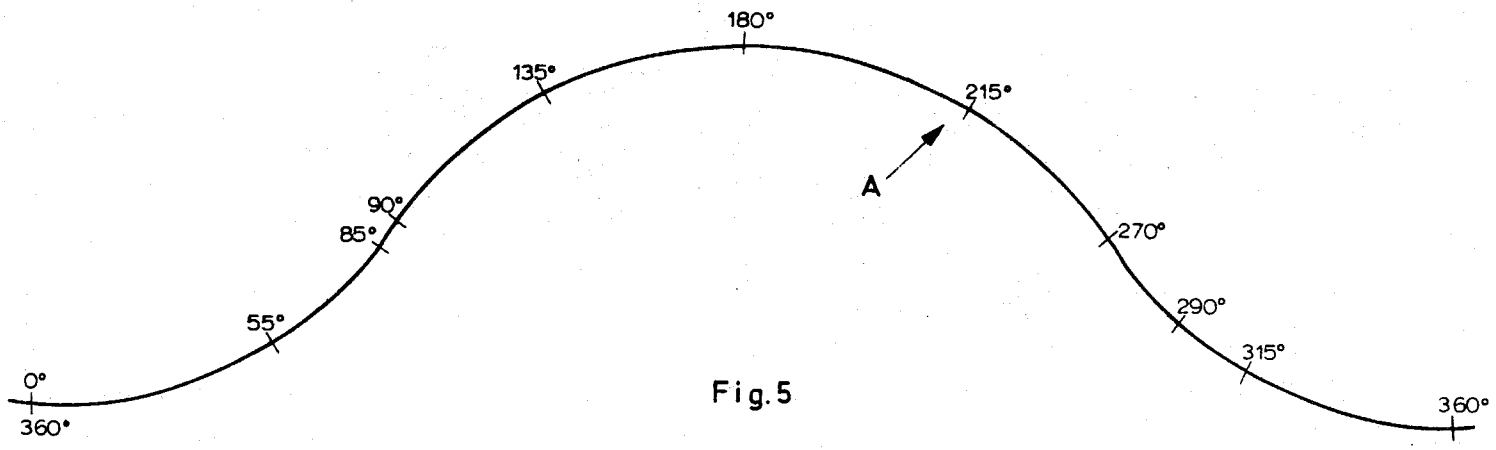
Fig. 5
| TRAVERSING OF BAR HALVES L4 AND L5 (NUMERALS 8, 9) | ANGLE OF ROTATION OF CAM SHAFT | DETAILS OF MOVEMENT | SCHEMATIC VIEW OF BAR HALVES 8 9 (L4 AND L5) |
|---|---|---|---|
| L4 = 0-8 +<br>L5 = 8-0 - | 0° | L4 SHIFTS FROM 0-8<br>L5 " " 8-0<br>FERRULE IN L4<br>STATION 1 | 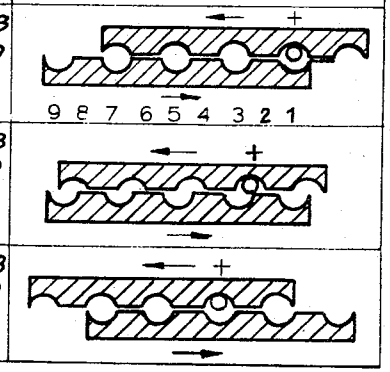 |
| L4 = 0-8 +<br>L5 = 8-0 - | 55° | L4 SHIFTS FROM 0-8<br>L5 " " 8-0<br>FERRULE IN L4<br>STATION 2 | 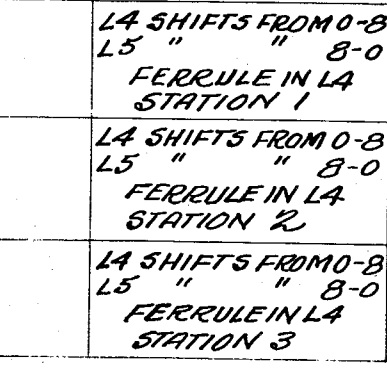 |
| L4 = 0-8 +<br>L5 = 8-0 - | 85° | L4 SHIFTS FROM 0-8<br>L5 " " 8-0<br>FERRULE IN L4<br>STATION 3 | 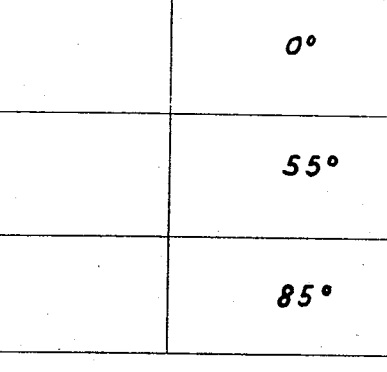 |

Fig. 5 (LOWER PART)
| | | | |
|---|---|---|---|
| L4 = 8 −<br>L5 = 0 + | 135° | L4 HAS SHIFTED TO 8<br>L5 " " " 0<br>FERRULE LEAPED FROM L4 TO L5 | 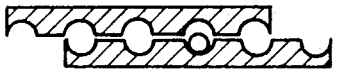 |
| L4 = 8 −<br>L5 = 0 + | 180° | L4 REST POSITION IN 8<br>L5 " " " 0<br>FERRULE REST POSITION L5: STATION 3 | 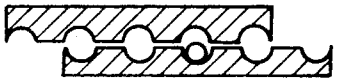 |
| L4 = 8 −<br>L5 = 0 + | 225° | " | 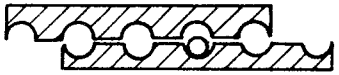 |
| L4 = 8 −<br>L5 = 0 + | 290° | " | 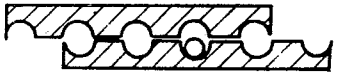 |
| L4 = 8-0 −<br>L5 = 0-8 + | 315° | L4 SHIFTS FROM 8 TO 0<br>L5 " " 0 TO 8<br>FERRULE IN L5 STATION 4 | 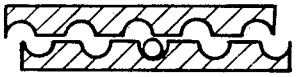 |
| L4 = 8-0 −<br>L5 = 0-8 + | 360° | L4 SHIFTS FROM 8 TO 0<br>L5 " " 0 TO 8<br>FERRULE IN L5 STATION 5 | 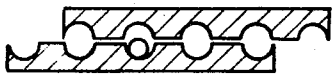 |

GUIDE BAR ASSEMBLY FOR A WARP KNITTING MACHINE

The present invention relates to a guide bar assembly for a warp knitting machine having yarn carrier elements disposed transversely of the guide bar, wherein the yarn carrier elements are releasable from the guide bar during the knitting process and adapted to be displaced in longitudinal direction relative to one or two guide bars.

In the conventional warp knitting machines, especially in raschel knitting machines, stitch formation is effected by upward and downward movement of the latch needle row as well as by a reciprocating movement (ejection) of the guide needle bars (guide bars) transversely of the latch needle row. Furthermore, the guide bars are traversed or shifted along the latch needle row. Normally, the guide bars comprise flat steel or aluminum section bars the length of which extends across the full width of the machine. The guide bars are provided, for instance, with threaded holes or the like for receiving yarn carrier elements therein.

The yarn carrier elements have the function of receiving and guiding the individual threads passing therethrough. Most frequently, guide or tubular needles are used. However, the term "yarn carrier elements" includes all types of carriers or holders of yarns, i.e. even hooks, eyes and the like, serving to transport a thread. Normally, the expert in the knitting art distinguishes between four basic bars (L1, L2, L3, L4) by means of which the base fabric may be laid or patterned. The subsequently positioned guide bars, amounting up to fourteen or more, are the pattern bars which are provided with separate yarn carrier elements in the respective positions as required by the pattern. The yarn carrier elements provided on the guide bars serve to guide and lay or place the threads during stitch formation. Customarily, their traversing or shifting movements are controlled by chain members through flitzer rollers and plungers or pushrods. In the depth direction, the complete guide bar assembly is controlled through guide bar levers by eccentric cams such that the individual threads come to lie on or behind the latch needles.

The traversing movement of the guide bars is limited. In modern types of machines, this so-called alternating or traversing height which is limited by the height and the weight of the control chain members, is at a maximum of $a$ = 150 mm. This value already takes into account that requirements of traversing movement of this magnitude require traversing levers to the ratio of 1 : 4 which, however, also increase flaw differences to the ratio of 1:4. For example, when pattern threads are drawn in, the width of the pattern formed is limited to $2a$, i.e. to 300 mm by using the above numerical example.

In view of the prior art, the present invention has as its object the provision of a guide bar assembly allowing to obtain a greater pattern width and an increased variety of patterns. Besides, a change of pattern should be possible without change of chains. Furthermore, the length of the longitudinal repeat, if desired, should be adapted to be varied without the necessity of resorting to long control chains. Also, jacquard patterns and similar patterns should be possible to be produced wherein — if desired — various patterns may be effected without limitation across the full width of the fabric. However, it should also be possible to provide novel patterns which allow interlacing of threads without warp threads to be obtained. Additionally, it should be possible to produce fabrics without foundation or base weave, whereby, preferably, no latch or patent needles are required in the latch needle row to this end.

This object is solved by a guide bar assembly wherein the yarn carrier elements are adapted to be released from the guide bar during the laying knitting operation, and traversed or shifted in the longitudinal direction relative to one or two guide bars.

Accordingly, in the assembly according to the present invention the yarn carrier elements, e.g. steel ferrules, eye or hook needles, are not fixedly mounted to a guide bar as in the conventional constructions; rather, these elements may be released or detached and then traversed in controlled manner relative to the guide bar across the width of the machine. In this operation, the yarn carrier elements each retain the thread or yarn drawn thereinto.

By combinations of movement, e.g. by using a plurality of yarn carrier elements adapted to be traversed simultaneously, entirely novel patterning technics can be obtained which were heretofore not possible to be effected in a knitting machine. Also, a small number of control chain elements of low height are required for the base bars and for the traversing movement of the pattern bars.

Actually, German Pat. No. 609,463 (K. Wunderlich) discloses a warp knitting machine of the type as outlined at the beginning, wherein the following features are realized:

a. The weft thread carriers are swingingly suspended so as to be adapted to perform limited lateral movement. Due to the existing construction, the ferrules or tubes 6' may be moved at most by the width 4a ($a$ = traversal of the guide bars);

b. the spacing of the ferrules 6' relative to the edge of the guide bar or to the stitch front is variable such that the presice stitch formation is aggrevated.

In contrast with this construction, the present invention solves the object of providing a guide bar assembly which allows to obtain a greater pattern width than that of 4a, and increased variety of patterns.

Preferably, each guide bar is divided into a pair of bar halves each, and it includes, in the longitudinal direction, discrete, separate stations or holding points for receiving the traversible yarn carrier elements, etc., whereby the stations or holding points each include a releasable device for retaining the respective yarn carrier element, whereby each bar half — in a manner known per se — is adapted to perform a longitudinal reciprocating movement relative to the other bar half. The spacing of the individual stations is hereby equal to an integer or a multiple of the latch needles within the latch needle row.

Preferably, ferromagnetic tubular needles are used as the yarn carrier elements. In this construction, each station is equipped with a semi-cylindrical recess carrying magnetizable areas on its inner peripheral surface. The tubular needles are held in these areas and drawn into the opposite recess when the corresponding areas of the opposite bar half are excited. This transfer is effected in fractions of a second. During the traversing movement of the bar halves relative to each other (which may be controlled in the manner of customary guide bars), the tubes or ferrules are each free to move from one bar half to the other thereby to travel a distance in the direction of the machine width. It is likewise possible that the tubes or ferrules intersect other ferrules or tubes during their travel, thereby to produce particular patterns.

In modification of the magnetic holding and releasing device, it is also proposed to provide means adapted to be electrostatically charged and discharged for retaining and releasing the tubular needles. In such case, the tubular needles may be made, for instance, from thin plastic material, thereby to reduce the mass — to be moved. It is likewise possible to effect pneumatic control of the elements.

A textile web produced by means of the guide bar assembly according to the invention can be distinguished by the fact that there is present an effect or fancy thread pattern being wider than twice the path of traversal of the guide bars.

Further details, properties and advantages are explained below by referring to a specific embodiment of the invention. In the Figures:

FIG. 5 is a functional diagram showing the travelling movement of a yarn carrier element according to the invention;

Figure 6B:
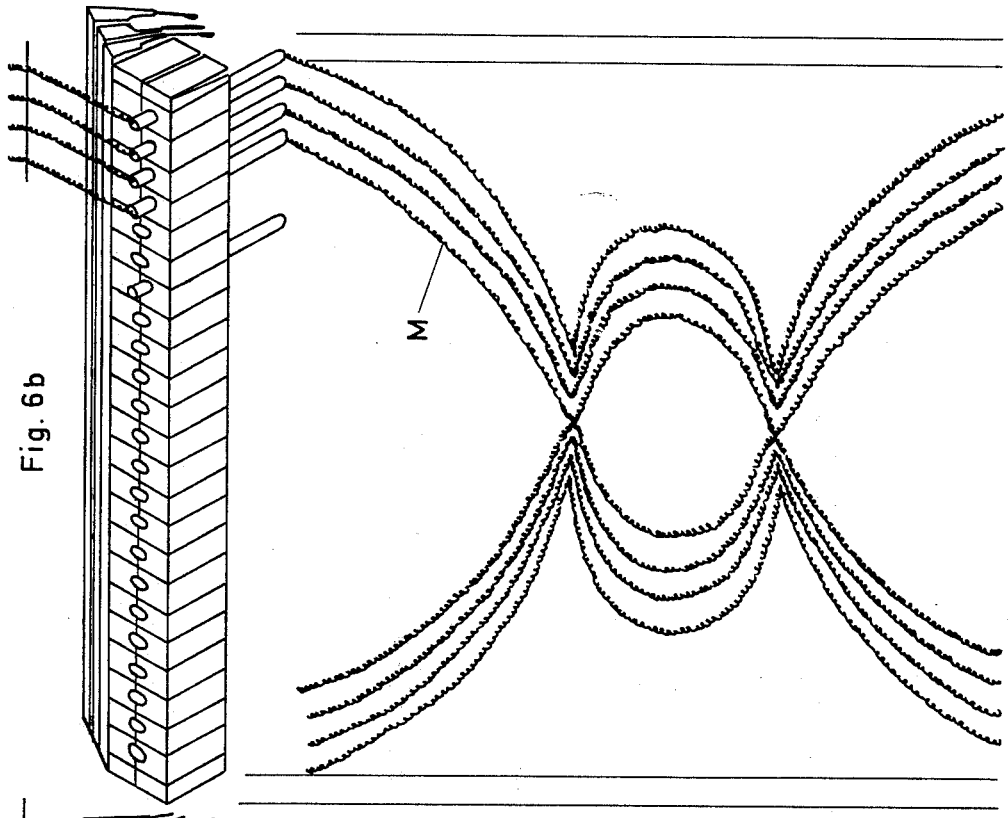
Figure 6A:
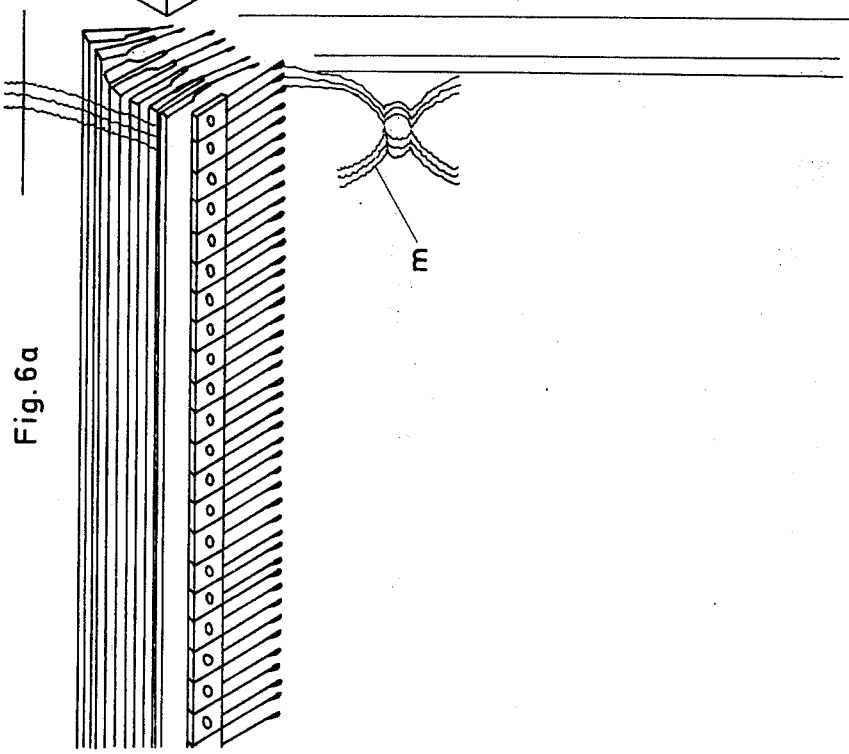
Figure 7:
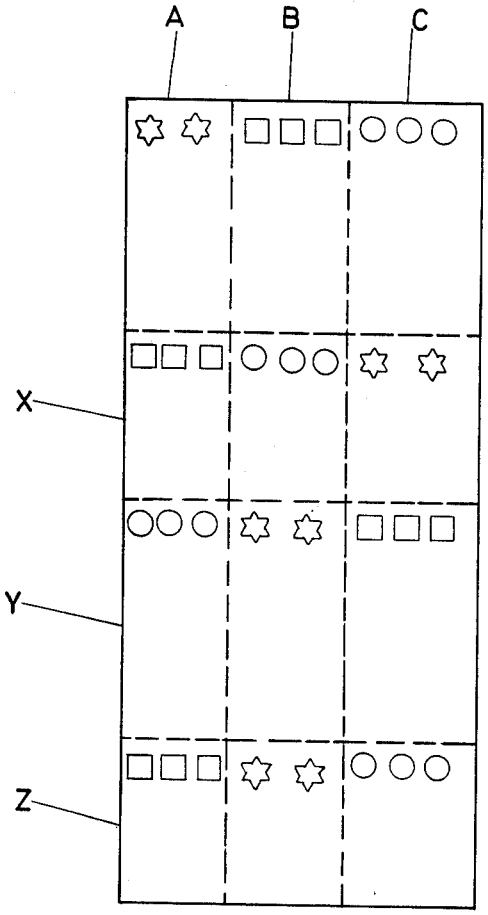

FIGS. 6*a* and 6*b* show examples of possibilities of patterning according to the prior art and according to the present invention, respectively; and FIG. 7 shows a further possibility of patterning.

Figure 1:
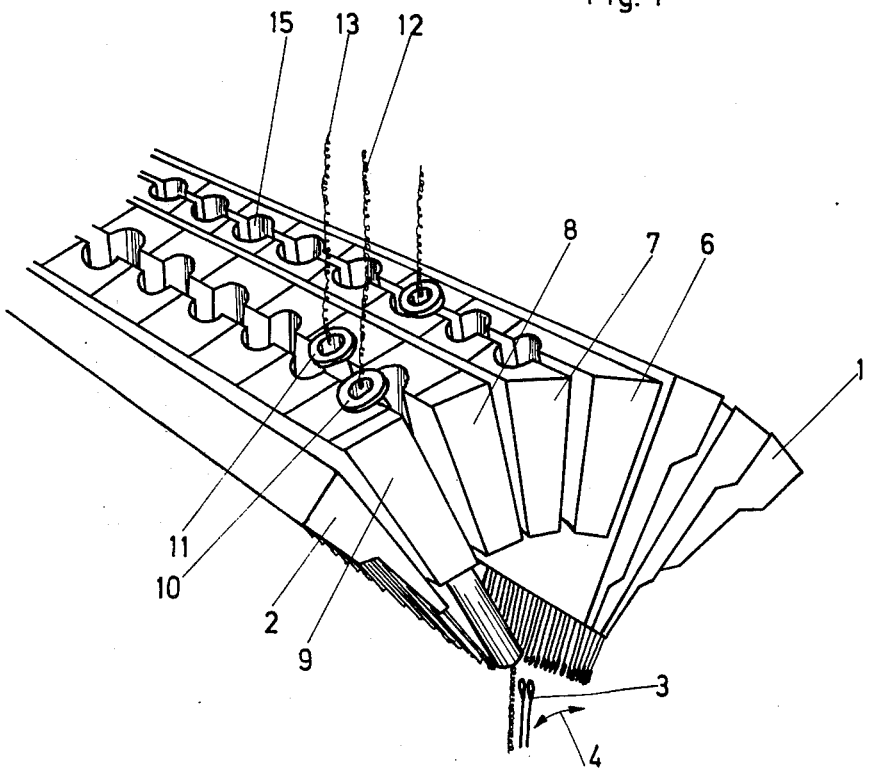
FIG. 1 is a perspectivic view of the arrangement and configuration of knitting tools comprising a guide bar assembly according to the invention.

FIG. 1 illustrates the knitting tools as customarily used in raschel knitting machines. Guides bars 1, 2 carrying guide needles are hereby arranged above the latch needles 3 so as to be adapted to swing to and fro in the direction of arrow 4 through the row of latch needles. In a manner known per se, the guide bars 1, 2 are secured to a suspension beam through hangers and guide elements and mounted to be separately movable along the latch needle row.

In this construction, the guide bars in the configuration shown together with the guide needles serve to form a base or foundation. However, additional guide bars 6 to 9 are provided for pattern formation. The guide bars 6 to 9 are formed as paired, mutually associated bar halves (6 and 7, and 8 and 9) in which the invention is embodied.

The pairs of bar halves are provided with semicylindrical, open apertures or recesses 15 which in the idle position are each opposite a corresponding aperture in the other bar. Ferrule-shaped yarn carrier elements 10, 11 are retained within the thus formed, approximately cylindrical bores. The pattern threads 12, 13 are drawn through elements 10, 11 to be fed to the place of operation of the knitting tools in the conventional manner.

The elements are formed of thin ferromagnetic steel sheet, and these elements are held or retained within the apertures by a magnetic force exerted on these elements. Hereby, these elements may be held both on the one side, i.e. within bar half 8, and on the opposite side, namely within the bar half 9. As the bar halves are traversed or shifted in opposite directions, the yarn carrier elements together with the yarn may be transported across the full width of the fabric. In this construction, the spacing of the bar halves is chosen to be of such size that these bar halves may be reciprocated with the tube needles resting in the apertures.

Figure 2:
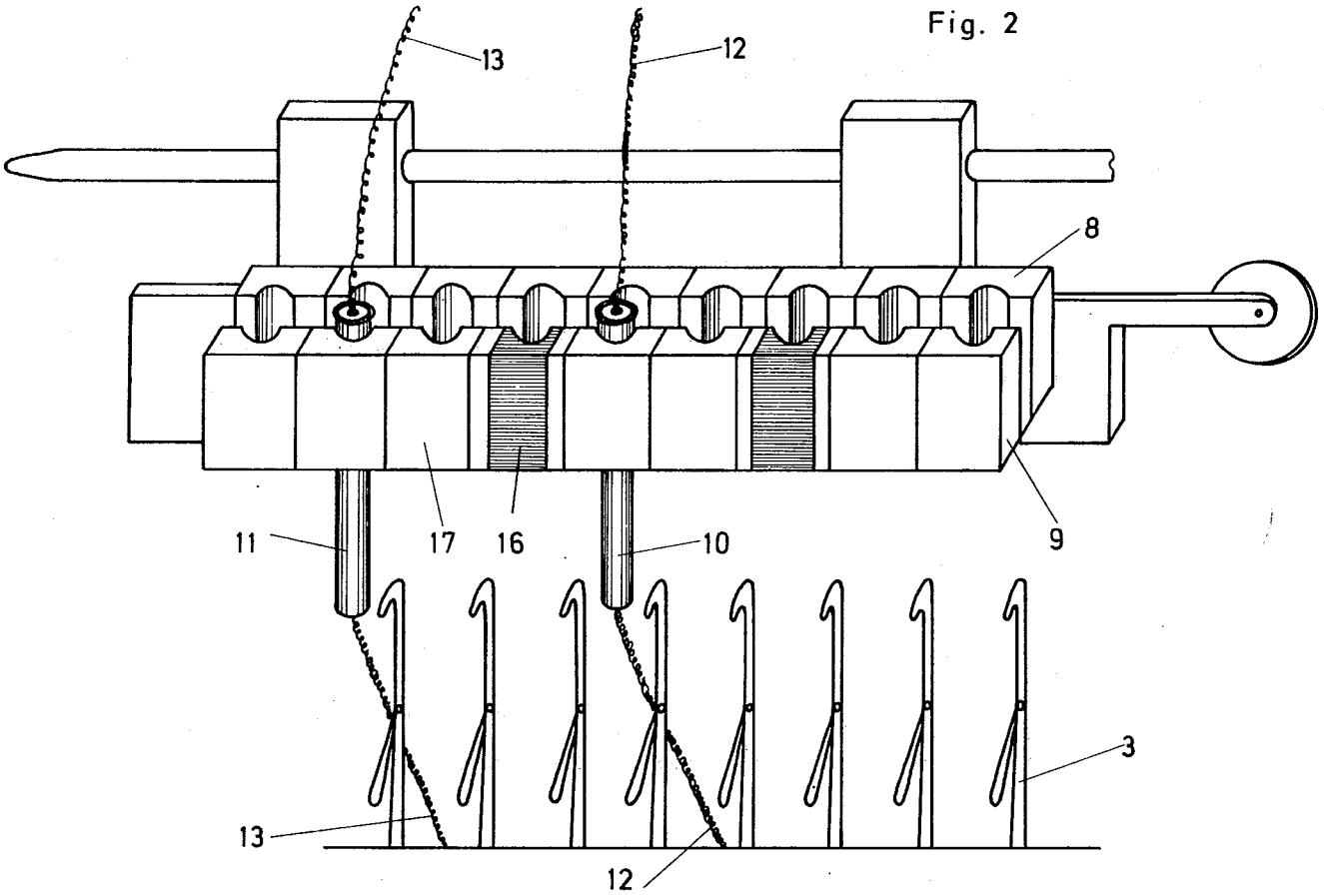
FIG. 2 shows a pair of guide bars (bar halves) having traversible yarn carrier elements according to the invention.

The attraction is produced by electromagnets 16 (FIG. 2) which are installed into each section 17 of the bar half 9 or 8 with their armatures and coils. Preferably, the metallic yokes and the coils (windings) of the magnets are potted in plastic material and combined at the rear face by means of a retainer or backing strip which at the same time forms the grounding line for the electrical feeding of the magnet coils. The second coil terminal is fed with electric current through a multiconductor cable (not shown).

Figure 3:
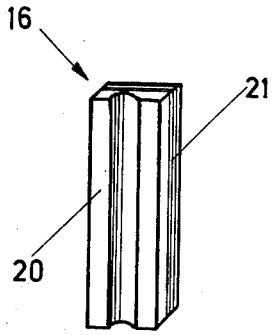
FIG. 3 shows station elements of a bar half.
Figure 4:
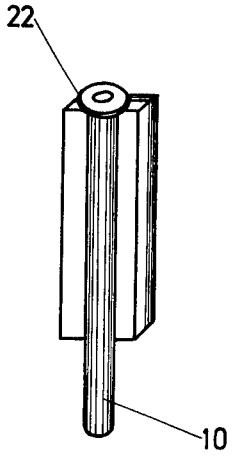
FIG. 4 shows a yarn carrier element.

FIG. 3 illustrates the electromagnet of a section or a tube needle station. The flanks of the armature 20 and the coil or winding 21 are clearly shown. FIG. 4 shows a yarn carrier element 10 positioned within the aperture of the armature. Element 10 comprises a thin-walled steel ferrule. At the upper end, such element includes a collar 20 being shaped to conically taper or diverge in downward direction and which prevents the an element 10 from slipping downwards when element is transferred from one bar half into the other. The distance between the bar halves is equal to about the diameter of element 10, plus 1 mm, such that only a small distance must be bridged in the jump and the pulses to be controlled are of very small magnitude.

The motion diagram of FIG. 5 illustrates the progress of the "travelling movement" of the yarn carrier element. The quantity of movement is patted by the angle of rotation of the camshaft of the knitting machine. Curve A represents the movement of the needle bar. In the following Table, the guide bars L 4 (reference numeral 8) and L 5 (numeral 9) are moved relative to each other. Hereby, the guide bar moves from position 0 to 8, i.e. it traverses by a specific distance relative to the stationary latch needle row.

The tubular needles, i.e. the yarn carrier elements 10, 11, are thus free to travel across the full width of the machine and thereby also to cross each other's paths. This allows absolutely novel patterning technics to be obtained, which were not possible to be executed on a knitting machine heretofore. Additionally, the traversing movement of the bar halves may be controlled by simple, conventional control chain members.

In order to allow a comparison between the designing patterns according to the prior art and those according to the invention 10, reference is made to FIGS. 6*a* and 6*b*.

FIG. 6*a* shows in the upper portion thereof the guide bars including the eye needles of well-known type. By traversing movement, patterns *m* may be produced whereby 10 patterns may be distributed across the full width of the repeat. In contrast, according to the novel method (FIG. 6*b*) patterns M may be obtained which extend across the full width of the repeat, by having, for example, four yarn carrier elements travel across the width and thereby to correspondingly tie up (interlace) the patterns threads.

Table

| Angle of rotation | Basic bars | (see also FIG. 5) Bar Halves L4 + L5 | Bar halves and tubular needle movement contact L4 + L5 |
|---|---|---|---|
| 0° | Needle bar lowest position: stitch is cast off; floating L2 and L3 in progress | L4 = from 0 to 8 + L5 = from 8 to 0 | L4 shifts from 0 to 8 L5 shifts from 8 to 0 Ferrule in L4 station 1 |
| 55° | Needle bar rises; opening of latches; floating still in progress | L4 = from 0 to 8 + L5 = from 8 to 0 − | L4 shifts from 0 to 8 L5 shifts from 8 to 0 Ferrule in L4 station 2 |
| 85° | Needle bar rises further; stitch slips over latch | L4 = from 0 to 8 +L5 = from 8 to 0 − | 0 shifts from 0 to 8 L5 shifts from 8 to 0 Ferrule in L4 station 3 |
| 135° | Needle bar reached uppermost point; floating finished-Guide bars swing rearwards | L4 = 8 − L5 = 0 + | L4 shifted to 8 L5 shifted to 0 Leap from L4 to L5 |
| 180° | Begin of overlap -i.e. L1 shifts | L4 = 8 − L5 = 0 + | L4 rest position in 8 L5 rest position in 0 Ferrule rest position in L5 - station 3 |
| 225° | Tuck position-thread of L1 within the hook | L4 = 8 − L5 = 0 + | " |
| 290° | Guide bars swing forwards - Needle bar starts to lower | L4 8 − L5 0 + | " |
| 315° | Stitch closes without latch-Floating L2 and L3 starts | L4 from 8 to 0 − L5 from 0 to 8 + | L4 shifts from 8 to 0 L5 shifts from 0 to 8 Ferrule in L5 station 4 |
| 360° | Needle bar moves into lowest position | L4 from 8 − 0 − L5 from 0 −8 + | L4 shifts from 8 to 0 L5 shifts from 0 to 8 Ferrule in L5 station 5 |

It is found that the novel assembly also allows to obtain some kind of jacquard patterns or design as is known from the weaving art. However, the novel assembly requires neither harness cords, nor needle displacement. Even fabrics without base or foundation weave, e.g. nets, may be produced with the aid of one or two pairs of bar halves.

The guide bar assembly may be used not only as an attachment or pattern device; rather, it can likewise be employed in novel textile machines wherein so-called leno weaves are used.

Control of the "travelling motion" of the yarn carrier elements, for instance, with the use of magnets, can be effected in accordance with the customary stepping method as is known e.g. in numerically controlled machine tools, textile machines and the like. In such case, pulse control means are used which effect that the jump or transfer is made at predetermined timed intervals, namely when the apertures of the pairs of bar halves are precisely opposite each other. With a corresponding construction, the current flow through the magnet may be interrupted thereafter if the magnets show a certain remanence sufficient to hold the ferrules in a rest position.

In well-known manner, control may be effected by means of punched tape or magnetic tape.

Considered on the whole, the novel assembly facilitates the realization of entirely novel types of patterns or design which were not known heretofore in the raschel method.

Further reference may be made to the possibility (FIG. 7) of varying the patterns across the width of the fabric web, independently of the shifting movement of the guide bars. FIG. 7 shows on reduced scale a fabric web being divided into three sections across its width and including three sections of different width (A: starlets; B: squares; C: circles). Besides, a variation of design may take place in the transition to section X, Y or Z, whereby different lengths of sections may be provided hereby, too. A warp change, as is normally necessary, does not take place. Accordingly, the possibilities of patterns include jacquard-like patterns or designs extending across the width of the web and including various repeat designs (motifs) distributed across the width, whereby the variety of differentiated repeat designs across one width is greater than $2a$ ($a$ = traversing movement or shift of the guide bars). Furthermore, the length or repeat may be varied. Control of the patterns by means of the freely movable (free-floating) tubular or ferrule needles is effected numerically, i.e. by means of an encoded magnetic tape, for instance.

What we claim is:

1. A guide bar assembly for use in a warp knitting machine, comprising:

a guide bar including two guide rails moveable relative to each other;

means for mounting said guide bar;

a plurality of independently controllable yarn carrir elements extending transversely between said guide rails;

means for releasing said yarn carrier elements from said guide rail during the knitting process and shifting said elements in the longitudinal direction relative to at least one of said guide rails, between predetermined positions substantially across the full length of said guide bar and means at said positions for receiving a yarn carrier.

2. The guide bar assembly according to claim 1, characterized in that each guide rail includes longitudinally separated discrete points for receiving and holding or retaining said shiftable yarn carrier elements in respective identical positions relative to the edge of said guide bar, which points each include a releasable device for retaining the respective yarn carrier element, whereby each bar rail performs a longitudinal reciprocating movement relative to the other bar rail.

3. The guide bar assembly according to claim 2 wherein said elements are tubular yarn carrier elements made of ferromagnetic material, and wherein each point is provided with a semi-cylindrical recess carrying magnetizable areas on its inner peripheral surface.

4. The guide bar assembly according to claim 3, wherein said releasing means includes an electromagnet.

* * * * *